United States Patent [19]

Kobayashi et al.

[11] Patent Number: 5,032,815

[45] Date of Patent: Jul. 16, 1991

[54] LAMINATION TYPE INDUCTOR

[75] Inventors: Takashi Kobayashi; Minoru Tamada; Yoshifumi Yamanaka; Hiroyuki Takeuchi, all of Nagaokakyo, Japan

[73] Assignee: Murata Manufacturing Co., Ltd., Kyoto, Japan

[21] Appl. No.: 456,748

[22] Filed: Dec. 26, 1989

[30] Foreign Application Priority Data

Dec. 23, 1988 [JP] Japan ..... 63-327224

[51] Int. Cl.[5] ..... H01F 15/02; H01F 27/30

[52] U.S. Cl. ..... 336/83; 336/172; 336/200; 336/225; 336/233

[58] Field of Search ..... 336/200, 232, 83, 223, 336/222, 233, 234, 172

[56] References Cited

U.S. PATENT DOCUMENTS

| | | | |
|---|---|---|---|
| 3,732,514 | 5/1973 | Sato | 336/223 X |
| 3,765,082 | 10/1973 | Zyetz | 336/200 X |
| 3,812,442 | 5/1974 | Muckelroy | 336/232 X |
| 4,543,553 | 9/1985 | Mandai et al. | 336/83 |
| 4,689,594 | 8/1987 | Kawabata et al. | 336/200 |

FOREIGN PATENT DOCUMENTS

| | | | |
|---|---|---|---|
| 3022347 | 2/1981 | Fed. Rep. of Germany | 336/200 |
| 2379229 | 9/1979 | France | 336/200 |
| 55-67158 | 5/1980 | Japan | 336/200 |
| 63-102215 | 5/1988 | Japan | 336/200 |

*Primary Examiner*—Thomas J. Kozma
*Attorney, Agent, or Firm*—Wenderoth, Lind & Ponack

[57] ABSTRACT

A lamination type inductor has a plurality of ferrite sheets assembled one above the other and laminated together, the uppermost and lowermost sheets being end sheets having lead-out conductor patterns thereon and conductor patterns on the surfaces of the end sheets which face each other which are connected to the lead-out conductor patterns and which are for connection to conductor patterns on intermediate sheets, and a plurality of intermediate ferrite sheets, each having a conductor pattern on one surface thereof which corresponds to a 0.25 turn of an inductor coil and a conductor pattern on the other surface which corresponds to a 0.5 turn of an inductor coil, each ferrite sheet having an opening therethrough through which the conductor patterns of the 0.25 and 0.5 turn are electrically connected to form a 0.75 turn of an inductor coil on each ferrite sheet. The conductor patterns on the successive intermediate sheets are connected to each other for forming an inductor coil having a number of turns which is a multiple of 0.75, and the conductor patterns on the upper surface of the uppermost of the plurality of intermediate ferrite sheets and the lower surface of the lowermost of the intermediate ferrite sheets are electrically connected to the conductor patterns on the surfaces of the end sheets which face each other for forming with the lastmentioned conductor pattern a complete inductor coil.

2 Claims, 6 Drawing Sheets

(a)

(a)

(b)

(b)

(c)

(d)

(a)

(b)

(c)

(d)

(e)

(f)

(g)

(h)

LAMINATION TYPE INDUCTOR

The present invention relates to a small-sized lamination type inductor to be used for preventing noise in a high-frequency circuit.

BACKGROUND OF THE INVENTION

Recently, stricter regulation has been enforced for prevention of noise in high-frequency circuits, and an inductance element for preventing such noise came to be required, with the result that a small-sized lamination type inductor has come to be used in the field of noise prevention.

In the conventional small-sized lamination type inductor of this kind, as shown in FIGS. 9 and 10, an I-shaped conductor pattern 5 having outside lead-out electrodes 3, 4 at both ends of conductive portion 2 thereof, is printed on the surface of an intermediate ferrite sheet 1 by using conductive paste mainly composed of silver, and thereafter, the ferrite sheet 1 has laminated to the front and rear surfaces thereof plain ferrite sheets 6, 6 intended to be dummy sheets, to which plane pressure is applied and the structure is at an appropriate temperature to make it integral.

Then, after barrel finishing, conductive paste is applied to the laminated body at both end portions thereof in a manner to communicate with the lead-out electrodes 3, 4 and the paste is baked to thereby obtain outside lead-out electrodes 7, 8.

But, in such a lamination type conductor having the construction as above, a problem occurs in that, since it is small in shape and the conductive portion 2 thereof is short in length and so on, the required inductance value cannot be obtained.

Accordingly, it has been proposed that a conductor pattern constituting a coil part be printed on ferrite sheets, which are laminated to form a lamination type coil so that a coil is formed, and the inductor can be used in the noise-prevention field to thereby solve the above-described problem.

FIG. 11 shows a construction for the case where a 5.5 turn coil is constructed by using a conventional lamination type coil.

In FIG. 11, a dozen ferrite sheets 11–22 are used. Conductor patterns 31–48 are printed on either the front surface or the reverse surface, or both, of each ferrite sheet, which is laminated in turn in such a way that sheet 12 is under sheet 11, and sheet 13 is under sheet 12, and so on. End portions of each conductor pattern are positioned on top of one another, and are connected to each other to form a coil.

In FIG. 11, the conductor pattern printed on the front surface of each ferrite sheet is shown in solid lines, and the pattern on the reverse surface in broken lines. Hereafter, the same method of illustration is adopted for the drawings of this invention.

In addition, each conductor pattern is printed on a sheet while the sheet is a green ferrite sheet, which sheet is then baked to thereby obtain a finished ferrite sheet. The same is true of the present invention.

First, on the reverse side of sheet 11 is printed a conductor pattern 31 constituting an outside lead-out portion 61 and coil portion 62 equal to a 0.25 turn coil to obtain a 0.25 turn coil.

Next, sheet 12 is provided with a through hole 63 near the end portion of one side thereof, and a conductor pattern 32, intended to be a coil portion equal to a 0.25 turn coil, is printed on the front sheet surface in a manner to position the end portion thereof over the through hole 63.

The above-described conductor pattern 32 is printed in such a manner as to push printing paste into through hole 63, and the printing is followed by printing, on the reverse side of sheet 12, of the conductor pattern 33 having the same shape as that of pattern 32, with the result that the paste is pushed into the through hole 63 from both the front surface and reverse side to connect the conductor patterns 32, 33 in a sure manner to thereby obtain a 0.5 turn coil.

Each of ferrite sheets 14, 16, 18 and 20 has the same construction as that of sheet 12. Each of sheets 13, 15, 17, 19 and 21 has a conductor pattern thereon, formed in a different direction from but having the paste applied in the same way as that of sheet 12. In each conductor pattern, the same numerals are used for like parts.

In addition, the lowermost ferrite sheet 22 is provided on the surface thereof with conductor pattern 48 formed at a position at the opposite end of the sheet from that of pattern 31 on the uppermost ferrite sheet 11.

As above, ferrite sheets 11–22 on which conductor patterns are printed are laid one on top of another in the way previously described, whereby end portion **62*a* of conductor pattern 31 on sheet 11 is connected to portion 32*a* of the pattern 32 on sheet 12. Likewise, end portion 33*a* of conductor pattern 33 of sheet 12 is connected to portion 35*a* of the pattern 35 on sheet 13**, so that as each sheet is laid on top of another, conductor patterns are connected to each other at the ends thereof to thereby constitute a coil.

But, with a coil in an inductor constructed as described above, a dozen ferrite sheets are required in order to obtain a 5.5 turn coil. In addition, said construction has not been satisfactory because of requirements for a large number of sheets and extensive conductor pattern printing and lack of work efficiency, workmanship, quality and because of cost.

OBJECT AND SUMMARY OF THE INVENTION

Accordingly, a first object of the invention is to provide a lamination type inductor capable of being constituted with a smaller number of ferrite sheets.

A second object of the invention is to provide a lamination type inductor enabling the numbers of conductor patterns applied to a ferrite sheet, extent of pattern printing and total number through holes to be reduced, whereby the number of process steps and materials used are also reduced to thereby cut costs.

A third object of the invention is to provide a lamination type inductor superior in quality to prior art inductors and capable of remarkably improving reliability as an inductor.

A fourth object of the invention is to provide a lamination type inductor in which the number of coils can be increased or decreased freely by selection of ferrite sheets and, moreover, a series of coils can be obtained in a simple way.

A fifth object of the invention is to provide a lamination type inductor on one sheet of which is printed a conductor pattern with a maximum 0.75 turn, thus completely eliminating abnormalities occurring between patterns on very small sheets such as a layer short and the like.

DETAILED DESCRIPTION OF THE INVENTION

Figure 1:
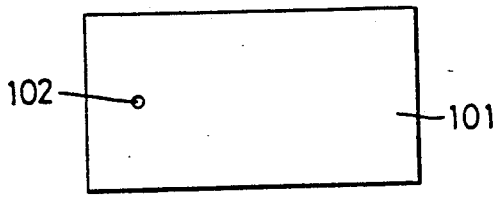
FIGS. 1(*a*) and 1(*b*) are plan views of a ferrite sheet for use in constituting a lamination type inductor according to the present invention.

FIGS. 1(*a*) and 1(*b*) show basic constructions of ferrite sheets for use in the inductor of this invention, in which two kinds of ferrite sheets are used: one is ferrite sheet 101 having through hole 102 along a shorter side as shown in FIG. 1(*a*), and the other is ferrite sheet 103 with through hole 104 along a longer side.

Using the above-described sheets 101, 103, three kinds of conductor patterns, 0.75, 0.50 and 0.25 turn, are formed by printing on both the front surface and reverse surface of the sheet to thereby make ferrite sheets having a conductor pattern which is a 0.5, 0.75, 1.0 or 1.25 turn coil on the front surface and reverse surface.

The 0.75 turn conductor pattern is formed with a lead-out portion and coil portion, and the 0.5 or 0.25 turn coil portions are formed without a lead-out portion.

When the conductor pattern extends along four sides of a ferrite sheet, the conductor pattern becomes one-turn coil and is referred to as 1 turn.

Accordingly, a conductor pattern extending 0.5 of the way around the sides of the sheet becomes a 0.5 turn coil and is referred to as 0.5 turn.

Figure 2:
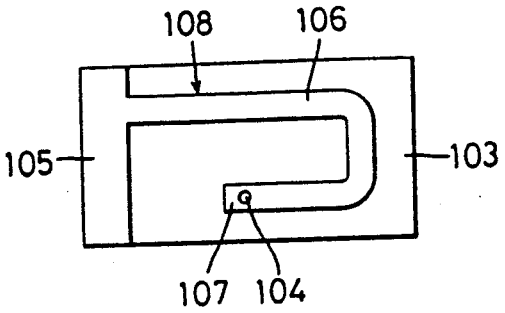
Figure 3:
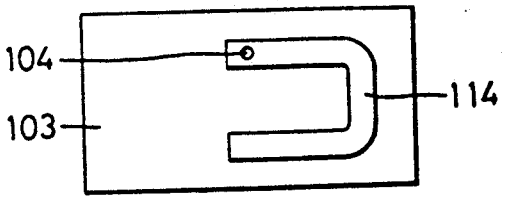

In order to constitute a 0.75 turn pattern, as shown in FIG. 2, conductor pattern 108, comprising 0.75 turn coil portion 106 including outside lead-out portion 105 and end connection portion 107, is applied to one side of ferrite sheet 103 with a through hole 104 therein by using conductive paste composed mainly of metal.

The end connection portion 107 is applied at a position covering through hole 104 to thereby allow the conductive paste to flow into hole 104 at the time of printing.

Hereafter, a pattern printing covering a through hole in this invention refers to printing using the method described above.

Figure 3:
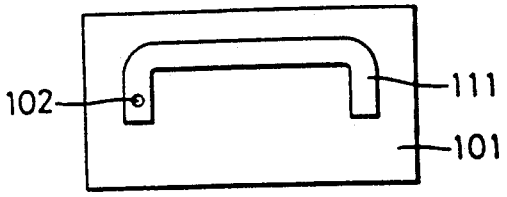
FIGS. 2–4(*h*) are plan views showing several kinds of conductor patterns.
Figure 1:
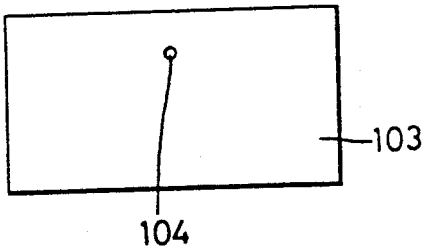
Figure 3:
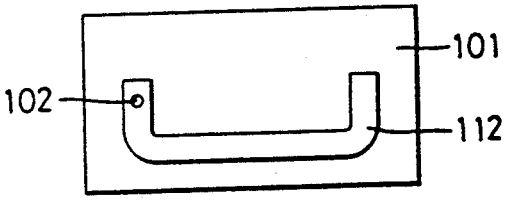
Figure 3:
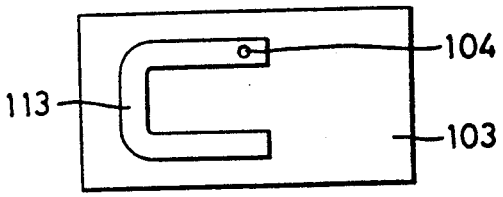

Next, in the case of a 0.5 turn pattern, there are four kinds. Wide U-shaped conductor patterns are applied to a surface of a ferrite sheet 101 with a through hole 102 formed along a shorter side with the bottom portions of the conductor patterns 111 or 112 extending along a longer side, as shown in FIGS. 3(*a*) and 3(*b*). Narrow U-shaped conductor patterns are applied to ferrite sheet 103 with a through hole 104 along a longer side with the bottom portions of the conductor patterns 113 and 114 extending along a shorter side as shown in FIGS. 3(*c*) and 3(*d*).

Conductor patterns 112 and 114 in FIGS. 3(*b*) and 3(*d*) are essentially the conductor patterns 111 and 113 in FIGS. 3(*a*) and 3(*c*) rotated by 180°. Thus, they are substantially identical to each other as conductor patterns, and provide two kinds of 0.5 turn patterns.

With respect to these two kinds of conductor patterns, conductive paste mainly of metal is applied in four patterns, as shown in FIGS. 3(*a*)–3(*d*), out of which required combination is selected for forming the desired coil.

In the case of a 0.25 turn conductor pattern, there are eight kinds. L-shaped conductor patterns 115–118 are applied to ferrite sheet 101 with a through hole 102 along a shorter side, in the upper left-hand quadrant, lower left-hand quadrant, upper right-hand quadrant and lower right-hand quadrant, respectively, as shown in FIGS. 4(*a*)–4(*d*); and likewise, L-shaped conductor patterns 119, 120, 121 and 122 are applied to ferrite sheet 103 with through hole 104 at a longer side thereof in the upper left-hand quadrant, lower left-hand quadrant, upper right-hand quadrant and lower right-hand quadrant, respectively, as shown in FIGS. 4(*e*)–4(*h*).

Figure 4:
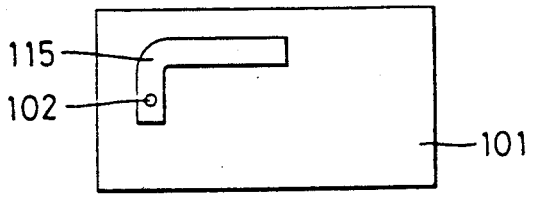
Figure 4:
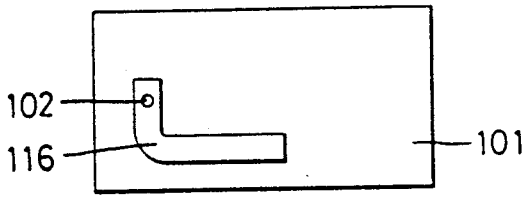
Figure 4:
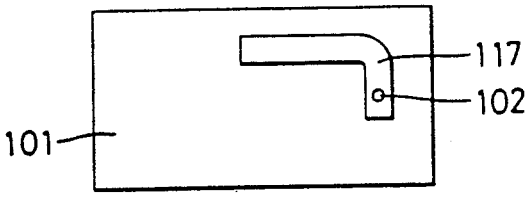
Figure 4:
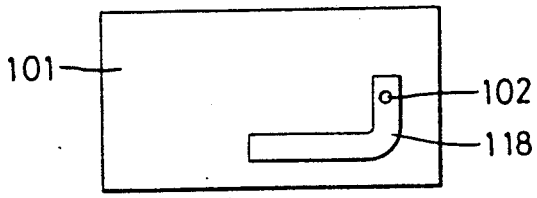
Figure 4:
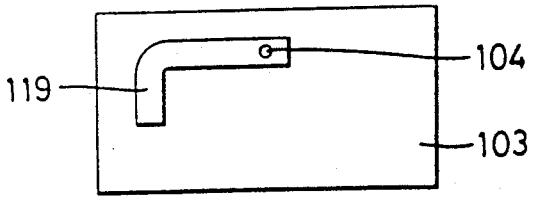
Figure 4:
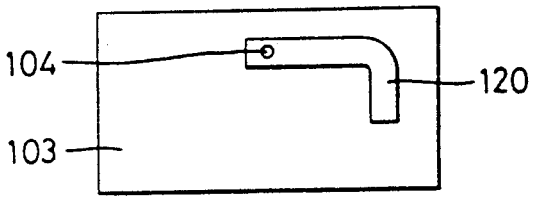
Figure 4:
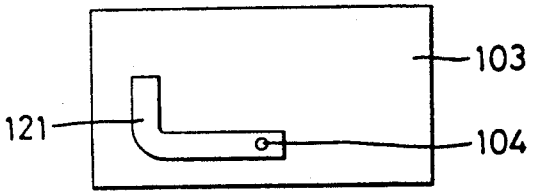
Figure 4:
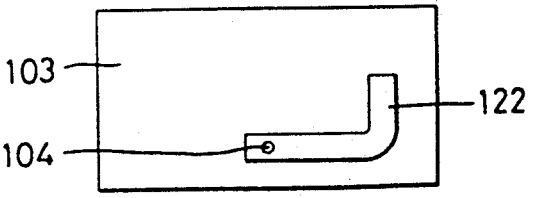

In FIGS. 4(*a*) and 4(*e*), the conductor patterns are identical to each other, except for the location of the through hole. The same is true of the patterns of FIGS. 4(*b*) and 4(*g*), FIGS. 4(*c*) and 4(*f*), and FIGS. 4(*d*) and 4(*h*), respectively. The patterns of FIGS. 4(*d*), 4(*c*), 4(*h*) and 4(*g*) are obtained by rotating the patterns of FIGS. 4(*a*), 4(*b*), 4(*e*) and 4(*f*) by 180°, respectively.

For forming these patterns, conductive paste mainly of metal is applied in the eight patterns, as shown in FIGS. 4(*a*)–4(*h*), from which patterns to achieve a required combination are selected for use.

Thus, for forming the lamination type inductor of this invention, there is one kind of printing pattern for forming a 0.75 turn, two kinds for forming a 0.50 turn and also eight kinds for forming a 0.25 turn, totaling five kinds of printing patterns, out of which a combination is selected for forming the desired inductor.

Next, the constitution of various coils for a lamination type inductor will be explained.

Figure 5:
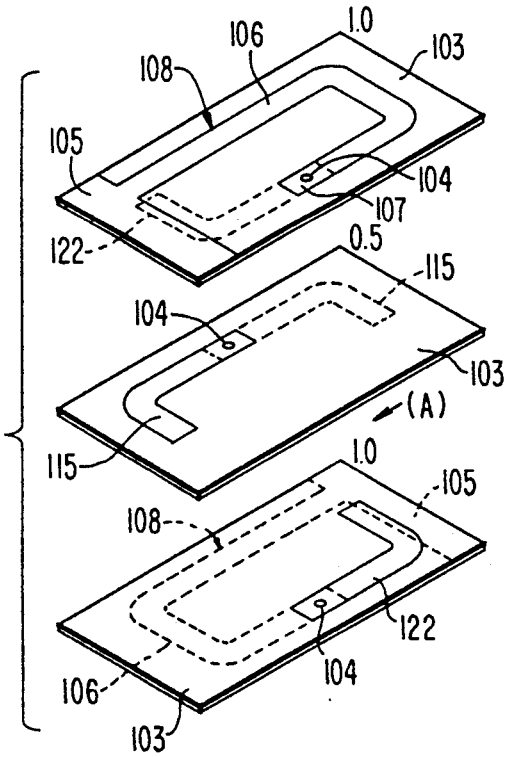
FIGS. 5–8 are exploded plan views showing examples of combinations of conductor patterns from which a coil is constituted.

FIG. 5 shows the structure of a 2.5 turn coil, wherein a selection of patterns is made from the above-described kinds of conductor patterns and they are applied to respective sheets to thereby obtain end sheets with 1.0 turns and an intermediate sheet with 0.5 turns, which are shown in descending order.

In FIG. 5, the solid lines show a conductor pattern printed on the upper surface of a ferrite sheet, and the broken lines show the conductor pattern on the reverse or lower side of the sheet, as described above. The reference numerals for each part correspond to those shown in FIGS. 1 through 4.

Printing of the conductor pattern on through hole 104 has been described before, that is, conductive paste flowing from both the upper surface and the reverse surface of ferrite sheet 103, at the time of printing conductor patterns 108 and 122, respectively, comes into contact in through hole 104 to thereby positively connect conductor patterns on the upper and reverse surfaces of the sheet.

The ferrite sheets are stacked in descending order as shown in FIG. 5 in a manner to connect end portions of the conductor patterns on the respective sheets to thereby obtain a 2.5 turn coil.

Figure 6:
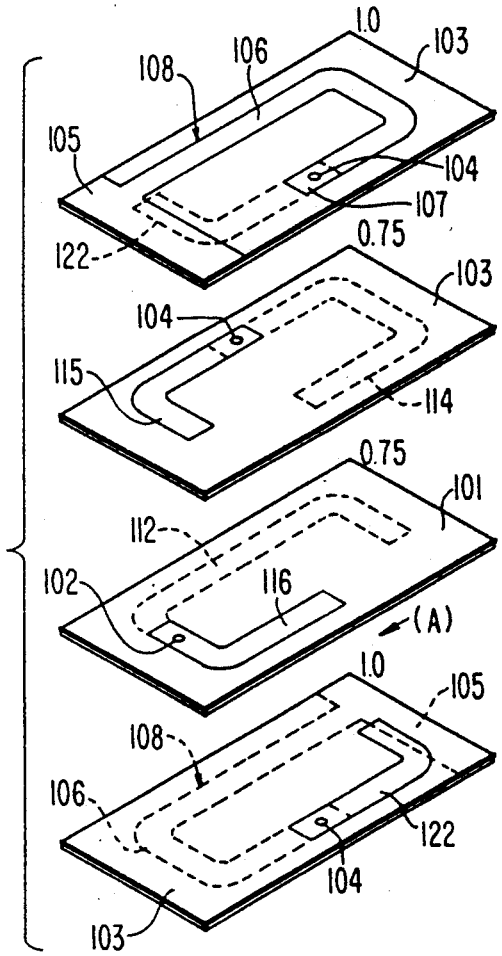

FIG. 6 shows the structure of a 3.5 turn coil. As in the case of FIG. 5, a selection of patterns has been made from among the above-described kinds of conductor patterns to obtain a combination of two end sheets each having a 1.0 turn and two intermediate sheets each having a 0.75 turn.

Figure 7:
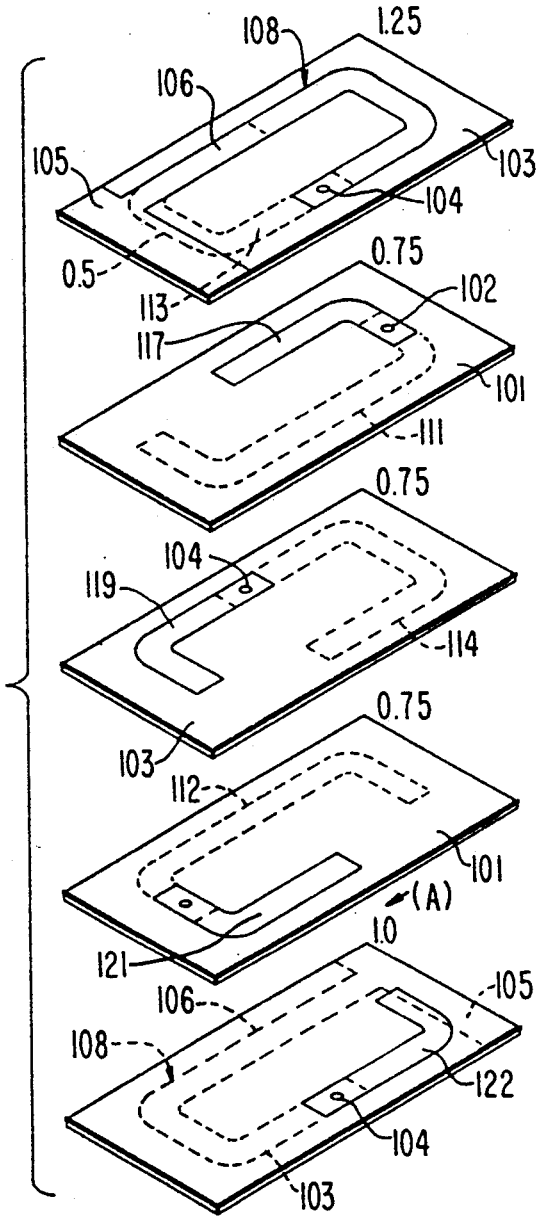

FIG. 7 shows, similarly, the structure of a 4.5 turn coil. As in the case of FIG. 5, a selection of patterns has been from among the above-described kinds of conductor patterns to obtain a combination of two end sheets respectively having 1.25 turns and 1.0 turns, and three intermediate sheets each having a 0.75 turn.

Figure 8:
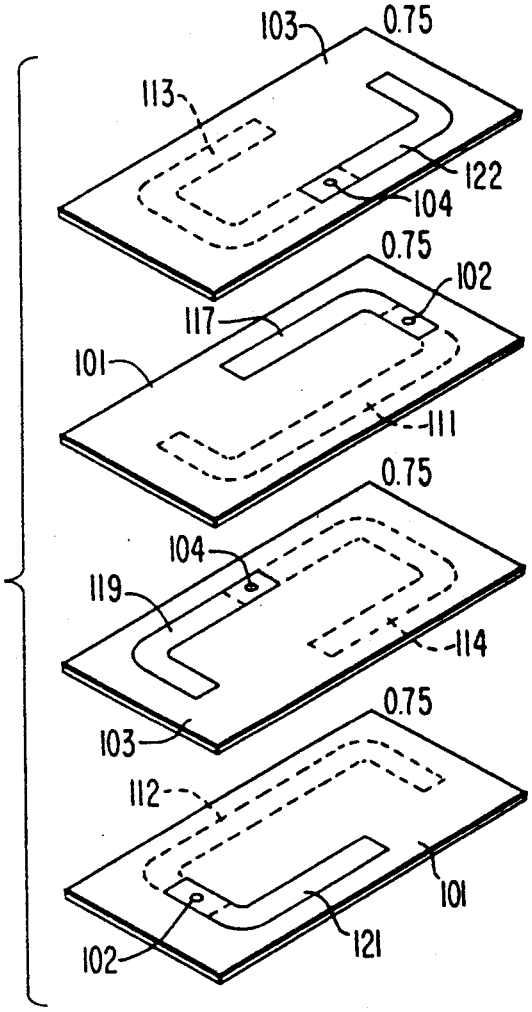

FIG. 8 shows the structure of a 3.0 turn coil without end sheets having conductor patterns having a lead-out portion. As in the case of FIG. 7, conductor patterns have been selected from among the above-described kinds of patterns to obtain four sheets, each with a 0.75 turn, and each being different from the other.

As described above, sheets can be assembled to form three kinds of coils, 2.5, 3.5, and 4.5 turn coils. The assembly of sheets to form a 3.0 turn coil as shown in FIG. 8 can be used as an insert in the 2.5, 3.5 and 4.5 turn coils in such a way that, when a set of sheets forming the insert is inserted in the position indicated by an arrow A in FIGS. 5, 6 or 7, i.e. between the bottom end sheet and the lowermost intermediate sheet, a coil having three additional turns is obtained.

For example, when a set of sheets as shown in FIG. 8 is inserted in the coils with 2.5, 3.5 or 4.5 turns, coils of 5.5, 6.5 or 7.5 turns are obtained, respectively.

Accordingly, a series of coils with 2.5, 3.5, . . . 7.5 turns can be constructed. In addition, if two sets of sheets are used as the insert, coils of 8.5, 9.5 or 10.5 turns are obtained, coils of 2.5, 3.5 . . . 10.5 turns can be constructed.

Figure 9:
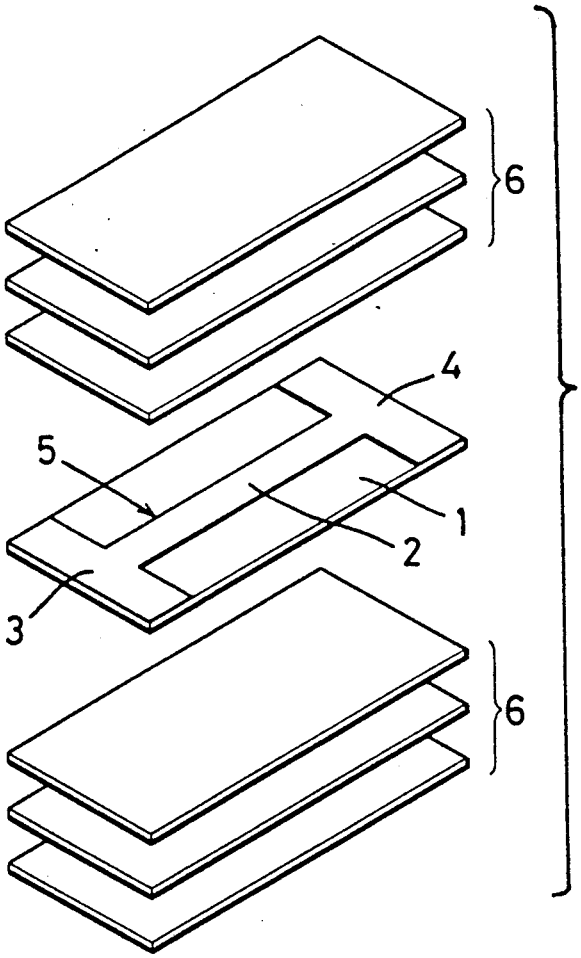
FIG.9 PRIOR ART
FIG. 9 is an exploded perspective view of the conventional lamination type conductor.
Figure 10:
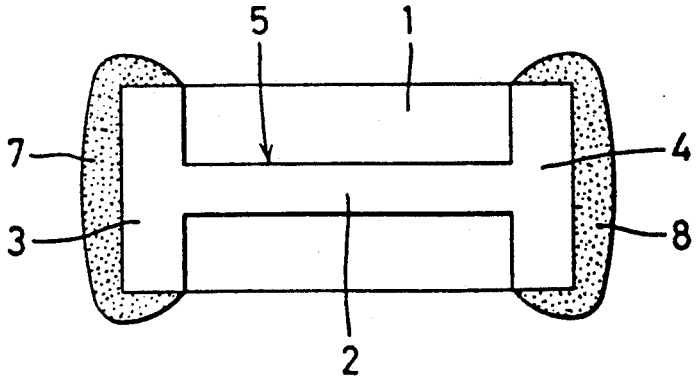
FIG.10 PRIOR ART
FIG. 10 is a plan view of the conductor of FIG. 9.
Figure 11:
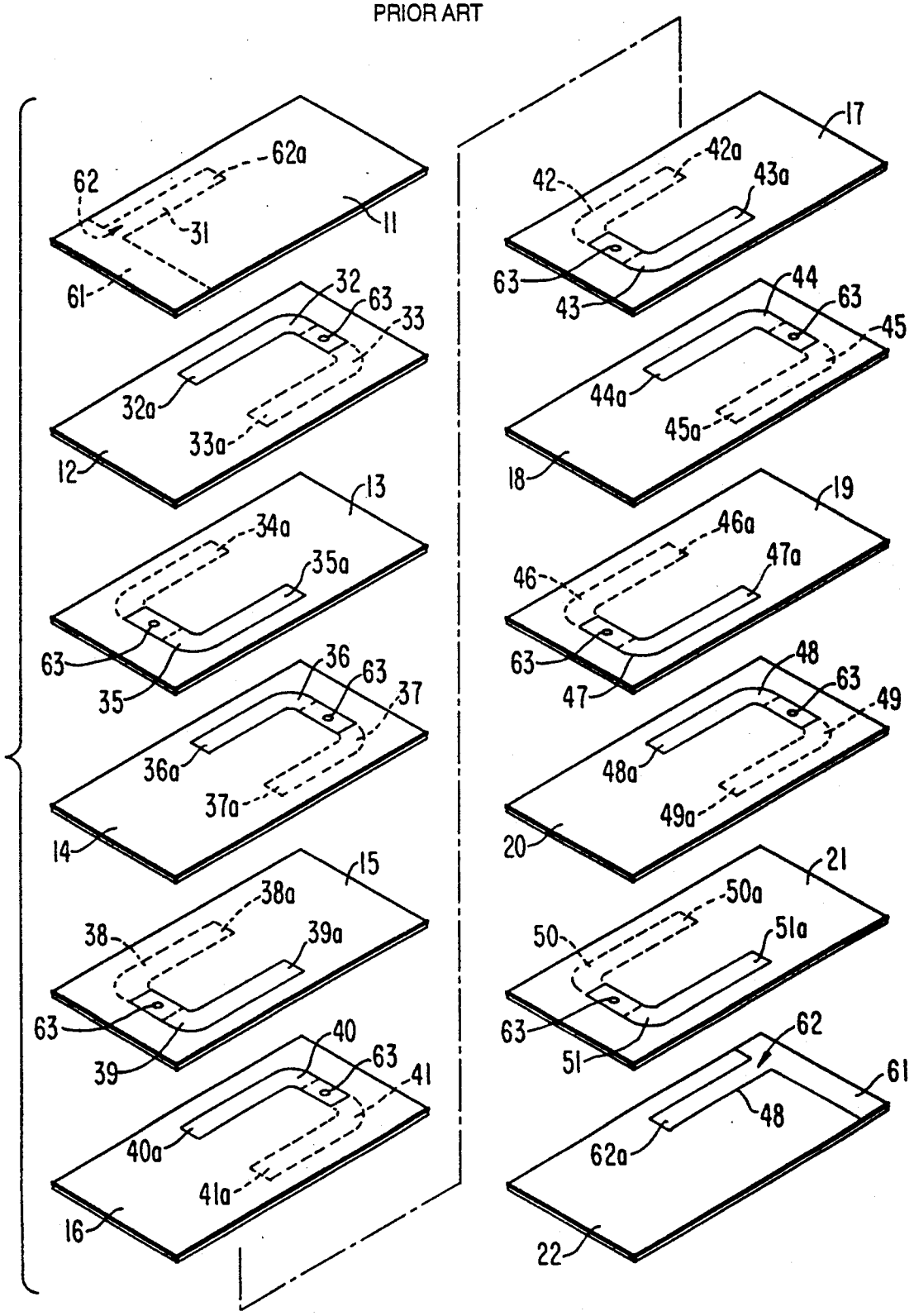
FIG. 11 PRIOR ART
FIG. 11 is an exploded plan view illustrating several kinds of conductor patterns from which a conventional coil is constituted.

Then lamination is carried out in the conventional manner as shown in FIG. 9, and steps of applying plane pressure, cutting, baking, barrel grinding, and applying outside electrodes are carried out on the coil-forming sheets sandwiched vertically between dummy sheets to thereby form the finished inductor.

In addition, if a lead-out portion is positioned at 90° or 270°, rather than at 180°, a series of coils not with 2.5, 3.5, etc. turns but with 2.0 turns or 3.0 turns, etc. as a minimum number of turns can be obtained. Moreover, these coil constructions can be widely utilized, for example, for a transformer constituting not only one coil but also two coils by disposing coil groups in a double setting.

As described above, a lamination type inductor according to this invention is so constituted that a coil is obtained by a selection of a combination of a plurality of kinds of conductor patterns, with the result that, for example, 10 ferrite sheets conventionally required for obtaining a 4.5 turn coil can be reduced to seven ferrite sheets to thereby reduce the number of ferrite sheets, conductor patterns, pattern printing, and total through holes, thus resulting in a decrease of processing steps and materials used, and at the same time remarkably improving the reliability of the device as an inductor.

Also, with this invention, pattern construction can be simplified for making a series of coils, and abnormalities such as layer shorts among patterns on extremely small sheets is completely eliminated.

We claim:

1. A lamination type inductor comprising: a plurality of ferrite sheets assembled one above the other and laminated together, the uppermost and lowermost sheets being end sheets having lead-out conductor patterns thereon and conductor patterns on the surfaces of said end sheets which face each other which are connected to said lead-out conductor patterns and which are for connection to conductor patterns on intermediate sheets, and a plurality of intermediate rectilinear ferrite sheets, each having a conductor pattern on one surface thereof which corresponds to a 0.25 turn of an inductor coil and extending from about the middle of a first side edge of the ferrite sheet to about the middle of an adjacent side edge and a conductor pattern on the other surface which corresponds to a 0.5 turn of an inductor coil and extending from about the middle of said adjacent side edge to about the middle of the edge opposite said adjacent side edge, each said ferrite sheet having an opening therethrough of about the middle of said adjacent side edge through which the conductor patterns of the 0.25 and 0.5 turn are electrically connected to form a 0.75 turn of an inductor coil on each ferrite sheet, the ends of the conductor patterns on the successive intermediate sheets being connected to each other for forming an inductor coil having a number of turns which is a multiple of 0.75, and the ends of the conductor patterns on the upper surface of the uppermost of said plurality of intermediate ferrite sheets and the lower surface of the lowermost of said intermediate ferrite sheets being electrically connected to the conductor patterns on said surfaces of said end sheets which face each other for forming with said lastmentioned conductor pattern a complete inductor coil.

2. A lamination type inductor as claimed in claim 1 in which said intermediate ferrite sheets are rectangular, and on a first intermediate ferrite sheet and any subsequent alternate ferrite sheets the conductor pattern corresponding to 0.25 turn extends from about the middle of a long side edge to about the middle of an adjacent short side edge and the conductor pattern on the opposite side of the ferrite sheet extends from about the middle of said short side edge to about the middle of the opposite short side edge, and on a second intermediate ferrite sheet and any subsequent alternate ferrite sheets the conductor pattern corresponding to 0.25 turn extends from about the middle of a short side edge to about the middle of an adjacent long side edge and the conductor pattern on the opposite side of the ferrite sheet extends from about the middle of said long side edge to about the middle of the opposite long side edge.

* * * * *